US008562456B2

(12) United States Patent
Sugimoto

(10) Patent No.: US 8,562,456 B2
(45) Date of Patent: Oct. 22, 2013

(54) GOLF CLUB HEAD

(75) Inventor: Yasushi Sugimoto, Kobe (JP)

(73) Assignee: SRI Sports Limited, Kobe (JP)

( * ) Notice: Subject to any disclaimer, the term of this patent is extended or adjusted under 35 U.S.C. 154(b) by 363 days.

(21) Appl. No.: 12/909,884

(22) Filed: Oct. 22, 2010

(65) Prior Publication Data

US 2011/0098129 A1 Apr. 28, 2011

(30) Foreign Application Priority Data

Oct. 23, 2009 (JP) ..... 2009-244280

(51) Int. Cl.
*A63B 53/04* (2006.01)

(52) U.S. Cl.
USPC ..... 473/331

(58) Field of Classification Search
USPC ..... 473/324–350
See application file for complete search history.

(56) References Cited

U.S. PATENT DOCUMENTS

| | | | |
|---|---|---|---|
| 6,814,673 | B2 | 11/2004 | Wahl et al. |
| 2007/0149312 | A1 | 6/2007 | Gilbert |
| 2008/0102981 | A1 | 5/2008 | Nguyen et al. |
| 2009/0036228 | A1 | 2/2009 | Ban et al. |
| 2009/0143165 | A1 | 6/2009 | Ban et al. |
| 2009/0143166 | A1 | 6/2009 | Ban et al. |
| 2009/0176596 | A1 | 7/2009 | Kobayashi |

FOREIGN PATENT DOCUMENTS

| | | | |
|---|---|---|---|
| JP | 2001-178856 | A | 7/2001 |
| JP | 2005-270517 | A | 10/2005 |
| JP | 2007-7181 | A | 1/2007 |
| JP | 2008-206984 | A | 9/2008 |
| JP | 2009-148538 | A | 7/2009 |

OTHER PUBLICATIONS

Chinese Office Action dated Mar. 23, 2012, for corresponding Chinese Application No. 201010533743.7, with English translation.

*Primary Examiner* — Alvin Hunter
(74) *Attorney, Agent, or Firm* — Birch, Stewart, Kolasch & Birch, LLP

(57) ABSTRACT

A golf club head 2 includes a face line 8 having a depth of D1 (mm) and a land area LA. When a boundary point between the land area LA and the face line 8 in a section line of a surface of the face line 8 is defined as Pa; a point of which a depth is T1 (mm) is defined as Pb; and a curvature radius of the section line between the point Pa and the point Pb is defined as R1 (mm), the golf club head 2 satisfies the following formulae (1) and (2):

$$R1>T1 \quad (1)$$

$$0.10 \leq T1 \leq 0.5 \quad (2)$$

Preferably, a ratio (R1/T1) is greater than 1.0 and is equal to or less than 3.0.

20 Claims, 9 Drawing Sheets

GOLF CLUB HEAD

The present application claims priority on Patent Application No. 2009-244280 filed in JAPAN on Oct. 23, 2009, the entire contents of which are hereby incorporated by reference.

BACKGROUND OF THE INVENTION

1. Field of the Invention

The present invention relates to a golf club head having a face line.

2. Description of the Related Art

Face lines are formed on many golf club heads. The face lines can contribute to increase in the backspin rate of a ball.

When the edge of the face line is sharpened, the backspin rate can be increased. However, in respect of the conformity to the rules, the sharp edge is not preferable. Therefore, a technique for applying a roundness and a chamfering to the edge is disclosed. Japanese Patent Application Laid-Open No. 2009-148538 (US2009/143165, US2009/143166) discloses a face line having an edge rounded so as to conform to the rules. Japanese Patent Application Laid-Open No. 2009-34393 (US2009/036228) discloses a face line having an edge having an arc-shaped notch. Japanese Patent Application Laid-Open No. 2008-114007 (US2008/102981) discloses a face line having a chamfered edge.

SUMMARY OF THE INVENTION

Foreign matters such as mud and sand may enter into a face line during a round at a golf course. These foreign matters reduce the performance of the face line.

The face line is formed by various methods. In respect of forming the face line having excellent dimensional accuracy, the face line is preferably formed by cutting processing. In this case, the face line is formed by a cutter. It was found that the cutter is apt to be damaged. The productivity of the head can be enhanced by enhancing the durability of the cutter.

It is an object of the present invention to provide a golf club head which has a face line having excellent foreign matter discharge property and has excellent spin performance and productivity.

A golf club head of the present invention includes a face line having a depth of D1 (mm) and a land area. When a boundary point between the land area and the face line in a section line of a surface of the face line is defined as Pa; a point of which a depth is T1 (mm) in the section line is defined as Pb; and a curvature radius of the section line between the point Pa and the point Pb is defined as R1 (mm), the head satisfies the following formulae (1) and (2):

$$R1>T1 \quad (1)$$

$$0.10\leq T1\leq 0.5 \quad (2)$$

Preferably, a ratio (R1/T1) is greater than 1.0 and is equal to or less than 3.0.

When a face line width measured by 30 degree method of measurement is defined as W1 (mm) and a bottom face width of the face line is defined as W2 (mm), preferably, a ratio (W1/W2) is 1.5 or greater and 3.0 or less.

In a section line of a surface of the face line, when a point of which a height from a bottom face of the face line is H1 (mm) is defined as Pc and an intersection point of a side face of the face line and the bottom face of the face line is defined as Pd, preferably, the point Pc coincides with the point Pb, or is located on a bottom face side than the point Pb. Preferably, a roundness having a curvature radius of r1 (mm) and projecting toward the outside of the face line is applied between the point Pc and the point Pd, and the curvature radius r1 is smaller than the curvature radius R1.

Preferably, the curvature radius R1 is constant and the curvature radius r1 is constant.

Preferably, a side face of the face line is occupied by only a first portion having the curvature radius R1 and a second portion having the curvature radius r1.

Preferably, the face line is formed by cutting processing using a cutter.

DESCRIPTION OF THE PREFERRED EMBODIMENTS

Hereinafter, the present invention will be described below in detail based on preferred embodiments with reference to the drawings.

Figure 1:
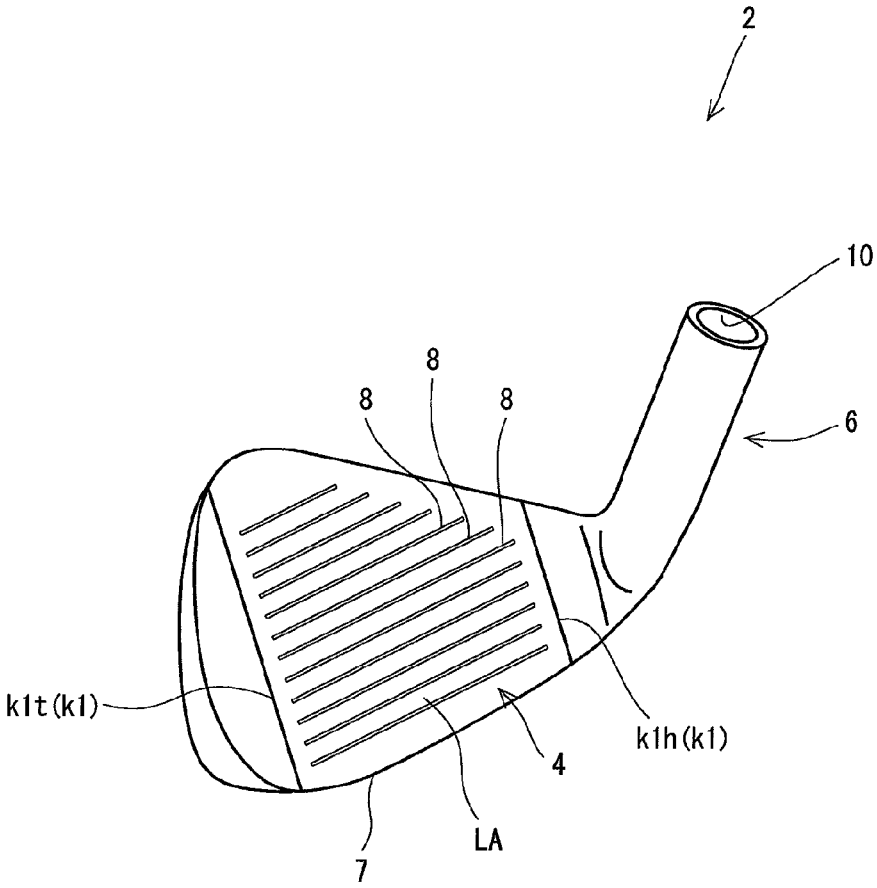
FIG. 1 is a perspective view of a golf club head according to a first embodiment of the present invention.
Figure 2:
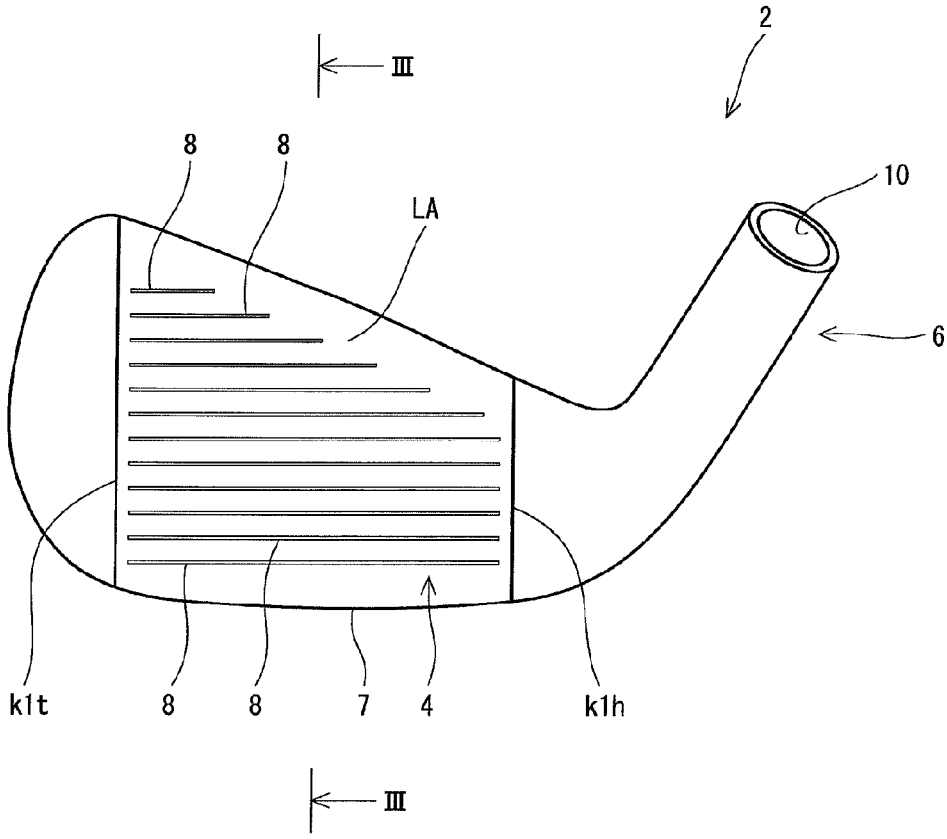
FIG. 2 is a view of the head of FIG. 1, as viewed from a position facing a face surface.

As shown in FIGS. 1 and 2, a head 2 is a so-called iron type golf club head. The head is also referred to as an iron head. The head is for right-handed golf player. A real loft angle of the iron type golf club head is usually 15 degrees or greater and 70 degrees or less.

The head 2 has a face 4, a hosel 6 and a sole 7. The face 4 has a face line 8 formed thereon. The golf club head 2 has a shaft hole 10 to which a shaft is mounted. The shaft hole 10 is formed in the hosel 6.

A material of the head 2 and the face 4 is not limited. The face 4 may be a metal, or may be a nonmetal. Examples of the metal include iron, stainless steel, maraging steel, pure titanium and a titanium alloy. Examples of the iron include soft iron (a low carbon steel having a carbon content of less than 0.3 wt %). Examples of the nonmetal include CFRP (carbon fiber reinforced plastic). A material used for a face part may be different from that used for a head body part.

The head 2 has the plurality of face lines 8. The face lines 8 are grooves. In the present application, the face lines 8 are merely also referred to as grooves.

Figure 3:
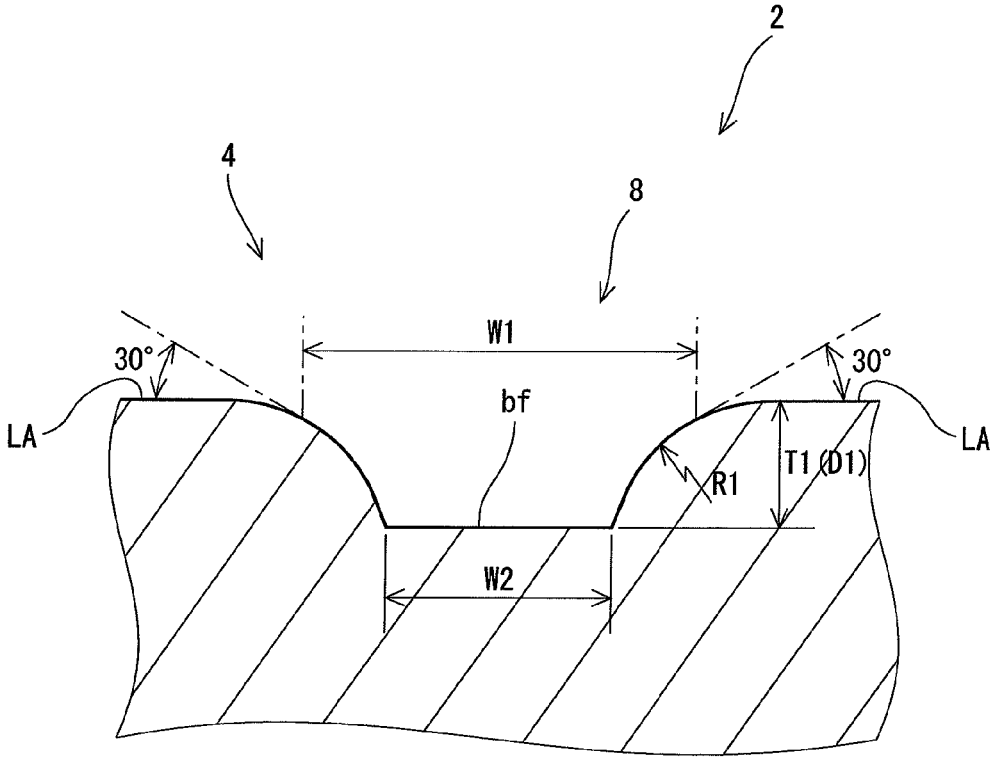
FIG. 3 is a view in which a cross sectional view taken along the line of FIG. 2 is partially enlarged.

FIG. 3 is a cross sectional view taken along the line III-III of FIG. 2. FIG. 3 shows only the vicinity of one face line 8. The face 4 has a land area LA. The land area LA indicates a portion of a surface (face surface) of the face 4 on which the grooves are not formed. If minute unevenness formed by a shot-blasting treatment or the like to be described later is disregarded, the land area LA is substantially a plane. In the present application, the land area LA is considered to be a plane.

Apart of the face 4 is subjected to a treatment for adjusting a surface roughness. The typical example of the treatment is the shot-blasting treatment. A boundary line k1 between an area which is subjected to the shot-blasting treatment and an area which is not subjected to the shot-blasting treatment is shown in FIGS. 1 and 2. An area between a toe side boundary line k1*t* and a heel side boundary line k1*h* is subjected to the shot-blasting treatment. All the face lines 8 are formed in the area which is subjected to the shot-blasting treatment. A toe side area relative to the toe side boundary line k1*t* is not subjected to the shot-blasting treatment. A heel side area relative to the heel side boundary line k1*h* is not subjected to the shot-blasting treatment. The toe side boundary line k1*t* and the heel side boundary line k1*h* are visually recognized by the presence or absence of the shot-blasting treatment. The surface roughness is increased by the shot-blasting treatment. The increased surface roughness can increase the backspin rate of a ball. The increase in the backspin rate tends to stop the ball near the point of fall. The increase in the backspin rate can facilitate the stopping of the ball at the aiming point. The increase in the backspin rate is particularly useful for a shot targeting a green and an approach shot. As shown in FIG. 2, the boundary layer k1*t* and the boundary layer k1*h* are substantially parallel.

In the present application, a depth D1 (mm) of the face line is defined. Hereinafter, the depth D1 is also referred to as a groove depth D1. The groove depth D1 is a distance between the land area LA and a bottom face bf of the face line. The groove depth D1 is measured along a direction perpendicular to the land area LA.

Figure 4:
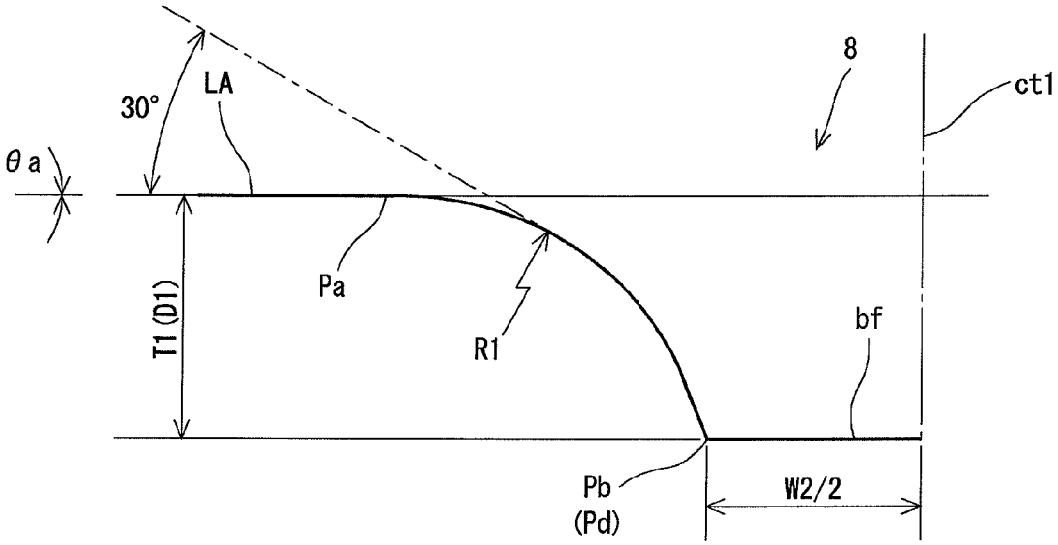
FIG. 4 is a view in which a section line of FIG. 3 is enlarged.

FIG. 4 is an enlarged view in which a section line of a surface of the face line 8 is described in the cross sectional view of FIG. 3. FIG. 4 shows a section line of a left half of the face line 8. The section line is axisymmetric about a central line ct1.

In the section line of the surface of the face line 8, a boundary point between the land area LA and the face line 8 is defined as Pa (see FIG. 4). In the section line of the surface of the face line 8, a point of which a depth is T1 (mm) is defined as Pb (see FIG. 4). In the embodiment, the groove depth D1 coincides with the depth T1.

A curvature radius of the section line between the point Pa and the point Pb is defined as R1 (mm). At this time, the face line 8 satisfies the following formulae (1) and (2):

$$R1>T1 \quad (1)$$

$$0.10\leq T1\leq 0.5 \quad (2)$$

The curvature radius R1 may be constant, or may be varied. In respects of the ease of manufacturing a cutter, of the durability of the cutter and of foreign matter discharge property, the curvature radius R1 is preferably is constant.

In the face line 8, an intersection point Pd of a side face of the face line and the bottom face bf coincides with the point Pb (see FIG. 4). In the face line 8, a portion having the curvature radius R1 occupies the whole side face of the face line 8. Even the face line 8 having such a simple sectional shape is found to have excellent spin performance. Since stress concentration to the cutter (to be described later) can be reduced in this case, the durability of the cutter can be enhanced. Since the shape of the tip part of the cutter is simple, the manufacturing cost of the cutter can be reduced.

In the embodiment, a ratio (R1/T1) is greater than 1.0 and is equal to or less than 3.0.

A face line width measured by 30 degree method of measurement is defined as W1 (mm), and a bottom face width of the face line is defined as W2 (mm) (see FIG. 3). In the embodiment, a ratio (W1/W2) is 1.5 or greater and 3.0 or less.

The "30 degree method of measurement" implies a measuring method described in the golf rules defined by R&A (Royal and Ancient Golf Club of Saint Andrews). "Groove volume" in the present application has a meaning described in the golf rules defined by R&A.

The effect of these numerical limitations will be described later.

Figure 5:
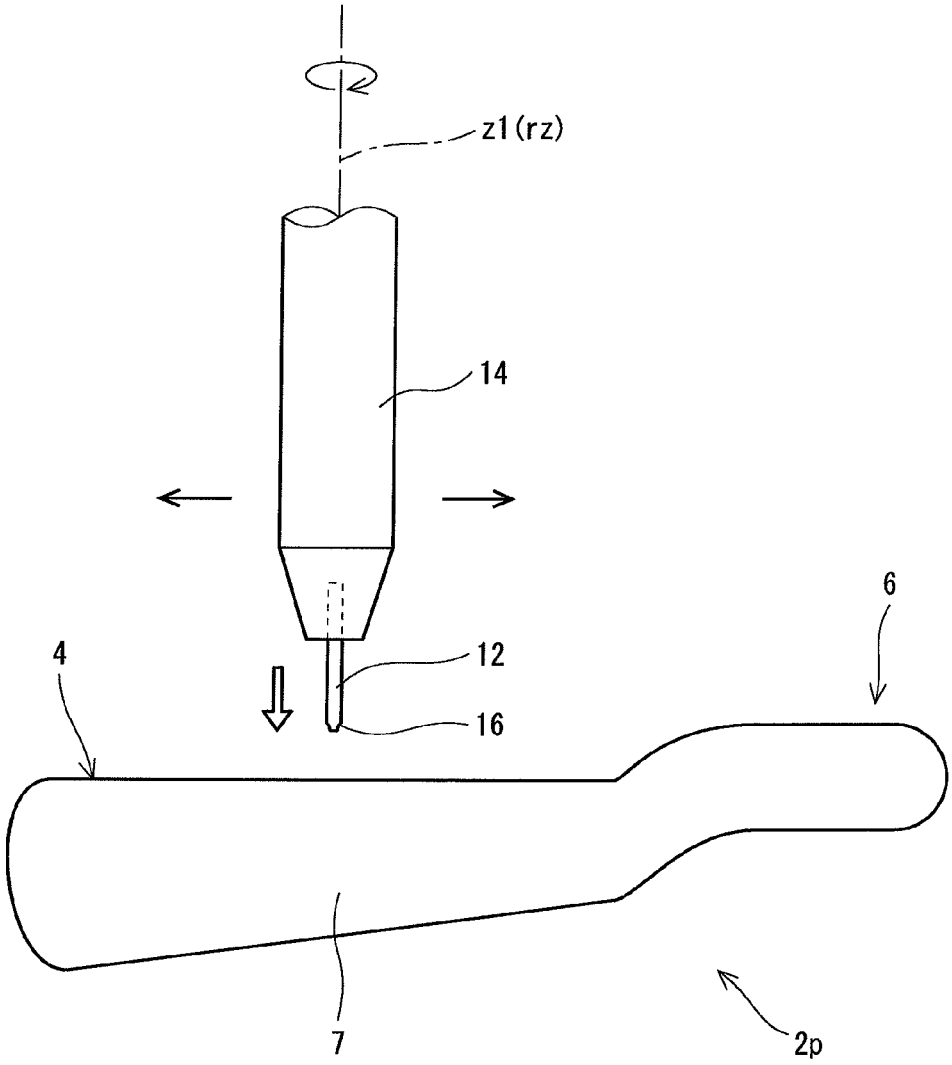
FIG. 5 is a view for explaining cutting processing by a cutter.

FIG. 5 is a view for explaining an example of a processing step of the face line 8. The face line 8 is formed by cutting.

In the step, an NC processing machine is preferably used. NC implies numerical control.

In the step, first, a head 2*p* in which the face line 8 is not formed is prepared (see FIG. 5). The head 2*p* is also referred to as a pre-line forming head. The head 2*p* is fixed with the face 4 horizontally set and faced upward. The head 2*p* is fixed by a jig, which is not shown.

In the step, the face line 8 is formed by a cutter 12 which is axially rotated.

The NC processing machine is provided with a body part (abbreviated in the figures), a cutter 12 and a base part 14. The cutter 12 is fixed to the base part 14. The cutter 12 is rotated together with the base part 14. A rotation axis rz of the cutter 12 is equal to a central axis line z1 of the cutter 12 (see FIG. 5).

A state where the central axis line z1 of the cutter 12 and the face 4 are perpendicular to each other is maintained during processing.

As the preferable material of the cutter 12, tungsten carbide and high hardness steel are exemplified.

The cutter 12 is moved while the axial rotation is maintained. The movement is controlled by the NC processing machine. The control is carried out by a program previously memorized in a control part of the NC processing machine.

The cutter 12 is moved to a predetermined cutting starting position (a position of an end of the face line 8) (see horizontal arrows of FIG. 5). Next, the cutter 12 descends (see an open arrow of FIG. 5). A position in the vertical direction of the cutter 12 during processing is determined according to the groove depth D1 previously set. Next, the cutter 12 is moved in the extending direction (an almost toe-heel direction) of the face line. Since the face line 8 of the embodiment is straight, the movement of the cutter 12 follows a straight line. The face 4 is scraped during the movement to form the face line 8. Next, the cutter 12 ascends. The cutting is completed by the ascending. Next, the cutter 12 is moved to a cutting starting position of another face line 8. Hereinafter, these operations are repeated to process the plurality of face lines 8. The face line 8 having the designed depth is formed at the designed position based on the program.

The cutter 12 forms the face line 8 by one time cutting. The sectional shape of the tip part 16 of the cutter 12 is equal to the sectional shape of the face line 8.

Figure 6:
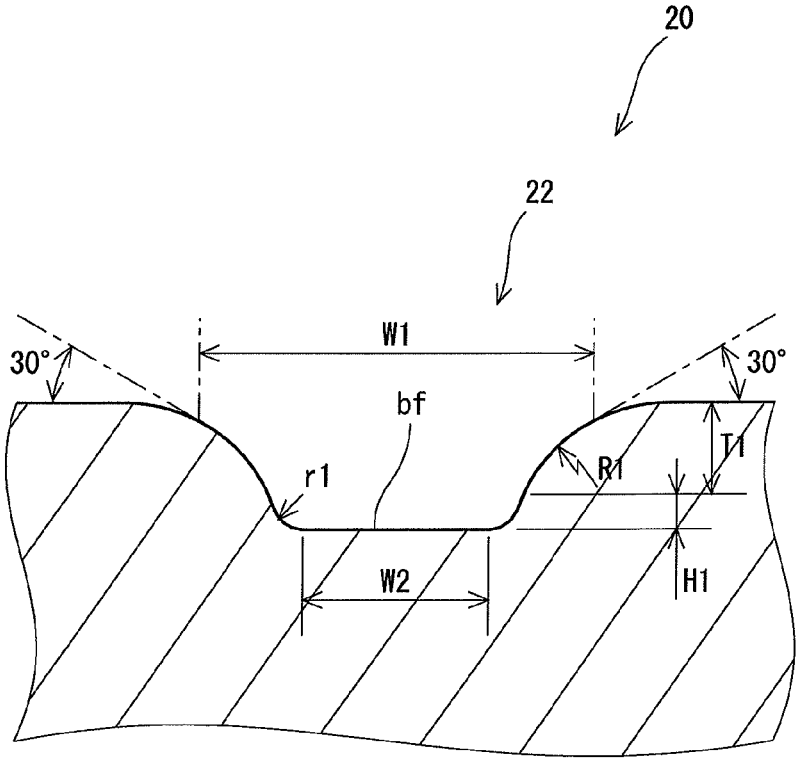
FIG. 6 is a cross sectional view of a vicinity of a face line of a head according to a second embodiment.

FIG. 6 is a cross sectional view of a golf club head 20 according to a second embodiment of the present invention. FIG. 6 is a cross sectional view of a face line 22. The head 20 is the same as the head 2 except for the sectional shape of the face line.

FIG. 6 shows only the vicinity of one face line 22. The head 20 has a land area LA.

Figure 7:
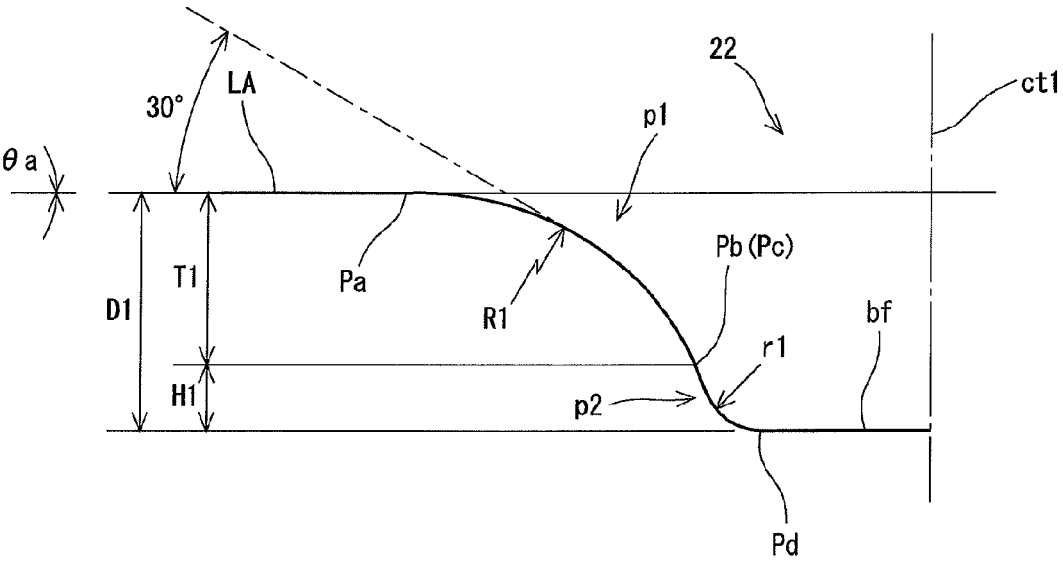
FIG. 7 is a view in which a section line of FIG. 6 is enlarged.

FIG. 7 is an enlarged view in which the section line of the surface of the face line 22 is described in the cross sectional view of FIG. 6. FIG. 7 shows a section line of a left half of the face line 22. The section line is axisymmetric about a central line ct1.

In the section line of the surface of the face line 22, a boundary point between the land area LA and the face line 22 is defined as Pa (see FIG. 7). In the section line of the surface of the face line 22, a point of which a depth is T1 (mm) is defined as Pb (see FIG. 4). In the embodiment, the groove depth D1 does not coincide with the depth T1. In the embodiment, the depth T1 is smaller than the groove depth D1.

A curvature radius of the section line between the point Pa and the point Pb is defined as R1 (mm). At this time, the face line 22 satisfies the following formulae (1) and (2):

$$R1>T1 \quad (1)$$

$$0.10\leq T1\leq 0.5 \quad (2)$$

The curvature radius R1 may be constant, or may be varied. In respects of the ease of manufacturing a cutter, of the durability of the cutter and of foreign matter discharge property, the curvature radius R1 is preferably constant.

In the embodiment, a ratio (R1/T1) is greater than 1.0 and is equal to or less than 3.0.

A face line width measured by the 30 degree method of measurement is defined as W1 (mm) and a bottom face width of the face line 22 is defined as W2 (mm) (see FIG. 3). In the embodiment, a ratio (W1/W2) is 1.5 or greater and 3.0 or less. The bottom face width W2 is a width of a plane portion. In the embodiment, the bottom face width W2 is a distance between points Pd to be described later.

A point of which a height from a bottom face of the face line 22 is H1 (mm) in a section line of a surface of the face line 22 is defined as Pc, and an intersection point of a side face of the face line 22 and a bottom face bf of the face line is defined as Pd.

The point Pc coincides with the point Pb, or is located on a bottom face bf side than the point Pb. In the embodiment, the point Pb and the point Pc coincide with each other.

A roundness having a curvature radius of r1 (mm) and projecting toward the outside of the face line 22 is applied between the point Pc and the point Pd. On the other hand, the curvature radius R1 is a roundness projecting toward the inside of the face line 22. A projecting direction of a roundness of a portion having the curvature radius R1 and a projecting direction of a roundness of a portion having the curvature radius r1 are opposite to each other (see FIG. 7).

The curvature radius r1 (mm) is smaller than the curvature radius R1 (mm).

The curvature radius r1 may be constant, or may not be constant. In respects of the ease of manufacturing the cutter, of the durability of the cutter and of foreign matter discharge property, the curvature radius r1 is preferably is constant.

In the embodiment, the side face of the face line 22 is occupied by only a first portion p1 having the curvature radius R1 and a second portion p2 having the curvature radius r1.

Foreign matters are apt to adhere to a bottom face bf. The foreign matters adhering to the vicinity of the bottom face bf are hardly discharged. Particularly, the foreign matters adhering to the vicinity of an intersection line of the side face of the face line 8 and the bottom face bf (that is, a corner of the groove bottom face bf) are hardly discharged. The foreign matters tend to be discharged by providing the second portion p2 having the curvature radius r1.

The provision of the curvature radius r1 can contribute to the durability of the cutter. When the second portion p2 (a portion having the curvature radius r1) of the face line 22 is formed by the cutter, a roundness having the curvature radius r1 is provided on the edge of the tip of the cutter. The roundness of the edge alleviates stress concentration to the tip of the cutter. The alleviation can enhance the durability of the cutter.

In the embodiment, the section line of the side face of the face line 22 is smoothly continuously formed between the point Pa and the point Pd. Therefore, the foreign matter discharge property is further enhanced, and the durability of the cutter tends to be enhanced.

Unlike the above-mentioned embodiment, the point Pb and the point Pc may not coincide with each other. That is, the point Pc may be located on the bottom face bf side than the point Pb. In this case, the shape of the section line between the point Pb and the point Pc is not limited. In respect of the foreign matter discharge property, the section line between the point Pb and the point Pc is preferably a straight line. In other words, a plane is preferably formed between the point Pb and the point Pc. It is preferable that the point Pb and the point Pc coincide with each other, which will be described later.

When the radius R1 is equal to or less than the depth T1, the edge of the face line is apt to be sharpened. In this case, problems of the damage of a ball or the conformity to the rules may be caused. In this respect, R1>T1 is preferable. That is, the ratio (R1/T1) is preferably greater than 1.0, more preferably equal to or greater than 1.10, and still more preferably equal to or greater than 1.50. In respect of spin performance, the ratio (R1/T1) is preferably equal to or less than 3.0, more preferably equal to or less than 2.7, and still more preferably equal to or less than 2.5.

In respects of the groove volume and of the spin performance, the depth T1 is preferably equal to or greater than 0.10 (mm), more preferably equal to or greater than 0.15 (mm), and still more preferably equal to or greater than 0.20 (mm). In respect of the conformity to the rules, the depth T1 is preferably equal to or less than 0.50 (mm), more preferably equal to or less than 0.45 (mm), and still more preferably equal to or less than 0.40 (mm)

In respect of the spin performance caused by the groove volume, the curvature radius R1 is preferably equal to or greater than 0.10 (mm), more preferably equal to or greater than 0.20 (mm), and still more preferably equal to or greater than 0.25 (mm). In respect of the spin performance caused by the edge, the curvature radius R1 is preferably equal to or less than 0.80 (mm), more preferably equal to or less than 0.70 (mm), and still more preferably equal to or less than 0.60 (mm).

When the curvature radius R1 is small, the angle of the tip of the cutter is apt to become small. In this case, stress is apt to concentrate on the tip of the cutter. Also in respect of the durability of the cutter, the curvature radius R1 is preferably equal to or greater than 0.10 (mm), more preferably equal to or greater than 0.20 (mm), and still more preferably equal to or greater than 0.25 (mm).

When a comparatively large curvature radius R1 is applied, it is thought that an edge effect is apt to be decreased as compared with the conventional face line. However, as shown in examples to be described later, it was found that the face line of the present invention provides spin performance comparable to that of a face line having a sharp edge.

In respect of the spin performance, the width W1 is preferably equal to or greater than 0.4 (mm), more preferably equal to or greater than 0.5 (mm), still more preferably equal to or greater than 0.6 (mm), and yet still more preferably equal to or greater than 0.7 (mm). In respect of the conformity to the rules, the width W1 is preferably equal to or less than 0.9 (mm), and more preferably equal to or less than 0.8 (mm).

In respect of the spin performance caused by the groove volume, the width W2 is preferably equal to or greater than 0.2 (mm), and more preferably equal to or greater than 0.5 (mm). In respect of the conformity to the rules, the width W2 is preferably equal to or less than 0.7 (mm), and more preferably equal to or less than 0.6 (mm).

In respect of the conformity to the rules related to the groove volume, the ratio (W1/W2) is preferably equal to or greater than 1.5, more preferably equal to or greater than 1.6, and still more preferably equal to or greater than 1.7. In respect of the spin performance caused by the edge, the ratio (W1/W2) is preferably equal to or less than 3.0, more preferably equal to or less than 2.7, and still more preferably equal to or less than 2.5.

In respect of the foreign matter discharge property, the height H1 is preferably equal to or greater than 0.03 (mm), and more preferably equal to or greater than 0.05 (mm). In respect of the spin performance caused by the groove volume, the height H1 is preferably equal to or less than 0.20 (mm), more preferably equal to or less than 0.15 (mm), and still more preferably equal to or less than 0.10 (mm).

In the face line 22 (see FIG. 6), the side face of the face line 22 is occupied by only the first portion having the curvature radius R1 and the second portion having the curvature radius r1. This is preferable in respects of good foreign matter discharge property and of tending to alleviate the stress concentration to the cutter.

In respect of the foreign matter discharge property, the curvature radius r1 is preferably equal to or greater than 0.02 (mm), more preferably equal to or greater than 0.03 (mm), and still more preferably equal to or greater than 0.04 (mm). In respect of the spin performance caused by the groove volume, the curvature radius r1 is preferably equal to or less than 0.15 (mm), more preferably equal to or less than 0.13 (mm), and still more preferably equal to or less than 0.10 (mm).

It is preferable that the section line is smoothly continuously formed between the point Pa and the point Pd in respects of the durability of the cutter and of the foreign matter discharge property.

In respect of the conformity to the rules, the groove depth D1 (mm) is preferably equal to or less than 0.508 (mm), more preferably equal to or less than 0.480 (mm), and still more preferably equal to or less than 0.460 (mm). In respect of the spin performance caused by groove volume, the groove depth D1 is preferably equal to or greater than 0.100 (mm), more preferably equal to or greater than 0.200 (mm), and still more preferably equal to or greater than 0.250 (mm).

The foreign matter discharge property implies the degree of discharge of the foreign matters included in the groove out of the groove. As the foreign matters, mud, sand, leaves of a lawn and water are exemplified. In particular, in a play at a golf course, the foreign matters enter into the face line in shot. The foreign matter reduces the spin performance. The face line having good foreign matter discharge property can have excellent spin performance.

An angle θa between a tangent line at the point Pa and the land area LA is not limited. In respect of suppressing the damage of the ball, it is preferable that the point Pa and the land area LA are smoothly continued. In this respect, the angle θa is preferably equal to or less than 20 degrees, preferably equal to or less than 10 degrees, more preferably equal to or less than 5 degrees, and most preferably 0 degree. In the case where a point Px (not shown) on the section line located between the point Pa and the point Pb is considered and a straight line Lax (not shown) connecting the point Px and the point Pa is further considered, the tangent line at the point Pa implies a line to which the straight line Lax comes close without limit when the point Px comes close to the point Pa without limit along the section line. In the embodiment of FIGS. 4 and 7, the angle θa is 0 degree.

A formation method of the face line is not limited. As the formation method of the face line, forging, press processing, casting and cutting processing (carving) are exemplified.

In the cutting processing, the cutting processing of the face line is carried out using the cutter. However, in the press processing, a face line mold which has a protruded part corresponding to the shape of the face line is used. The face line mold is forced on the face to form the face line. The face line mold in the press processing may be referred to as a "face line engraved mark" by a person skilled in the art.

In the case of the forging, the mold is comparatively inexpensive, and maintenances such as correction are also easy. On the other hand, in the case of the forging, a receiving jig for supporting the back side of the head is required. The receiving jig requires high accuracy. The heat treatment in the forging is apt to generate organization change. The organization change may cause strength reduction.

In the case of the forging, the face line mold is inexpensive, and maintenances such as correction are also easy. On the other hand, in the case of the press processing, a receiving jig for supporting the back side of the head is required. The receiving jig requires high accuracy.

Since the face line is also formed in the casting while the head is cast, there is less time and effort for forming the face line. However, the molten metal stream during the casting may cause the occurrence of a defect in the face line.

In respect of the accuracy of the sectional shape of the face line, the cutting processing is most preferable.

In the cutting processing, the edge of the face line is apt to be excessively sharp. The edge is apt to damage the ball. In this respect, processing for rounding the edge may be carried out after the cutting processing. Buff and shot blasting are exemplified as processing for rounding the edge. The buff is carried out, for example, by a wire brush. When processing for rounding the edge after the cutting processing is carried out, the variation in the sectional shape of the face line is apt to occur. In this respect, the edge is preferably rounded by the cutting processing. That is, the curvature radius R1 is preferably applied by the cutter. Similarly, the curvature radius r1 is preferably applied by the cutter. In respect of productivity, it is preferable that the cutter applies the curvature radius R1 and the curvature radius r1 simultaneously.

A formation method of the face line is not limited. As the formation method of the face line, forging, press processing, casting and cutting processing (carving) are exemplified. In the case of the face line formed by the cutting processing using the cutter, the durability of the cutter can be enhanced by the present invention. The enhancement in the durability of the cutter can cause enhancement in the productivity and reduction in a production cost.

A groove distance S1 (a width of the land area LA between two adjacent grooves) is preferably set in consideration of the conformity to the golf rules. In respect of the conformity to the rules, the groove distance S1 is preferably equal to or greater than three times the groove width W1.

EXAMPLES

Hereinafter, the effects of the present invention will be clarified by examples. However, the present invention should not be interpreted in a limited way based on the description of the examples.

Example 1

A head for a sand wedge of "XXIO5 IRON" (trade name) was used as a head having no face line formed thereon. The loft of the head was 58 degrees, and the lie angle was 63.5 degrees. The material thereof was SUS630, and the forming method was casting. The face line was formed on the head. In the method shown in FIG. 5, face lines were formed by cutting processing using a cutter. The material of the cutter was tungsten carbide. The sectional shape of the cutter was made the same as that of the face line. Therefore, the face lines were formed by one time cutting.

The number of the face lines provided on one head was 16. The pitch of the face lines was 3.2 (mm). The length of the longest face line was 55 (mm).

The face surface on which the face lines were formed was subjected to shot finishing. The shot finishing does not change the sectional shape of the face line substantially.

A shaft and a grip were mounted to the obtained head to obtain a golf club. "NS950 R" (trade name) manufactured by Nippon Shaft Co., Ltd. was used as the shaft. A club length was set to 35.5 inches. A swing balance (14 inch method) was set to D2.

Examples 2 to 6

Heads having face lines having different sectional shapes were obtained by changing the shape of a cutter. Heads and clubs of examples 2 to 6 were obtained in the same manner as in the example 1 except for the specifications shown in the following Table 1.

The sectional shapes of the examples 1 to 5 were set as shown in FIGS. 6 and 7. In the examples 1 to 5, the side face of the face line was occupied by only the first portion having the curvature radius R1 and the second portion having the curvature radius r1. On the other hand, the sectional shape of the example 6 was set as shown in FIGS. 3 and 4. The side face of the face line was occupied by only the portion having a curvature radius R1.

Comparative Examples 1 to 3

Heads having face lines having different sectional shapes were obtained by changing the shape of a cutter. Heads and clubs of comparative examples 1 to 3 were obtained in the same manner as in the example 1 except for the specifications shown in the following Table 1.

Figure 8:
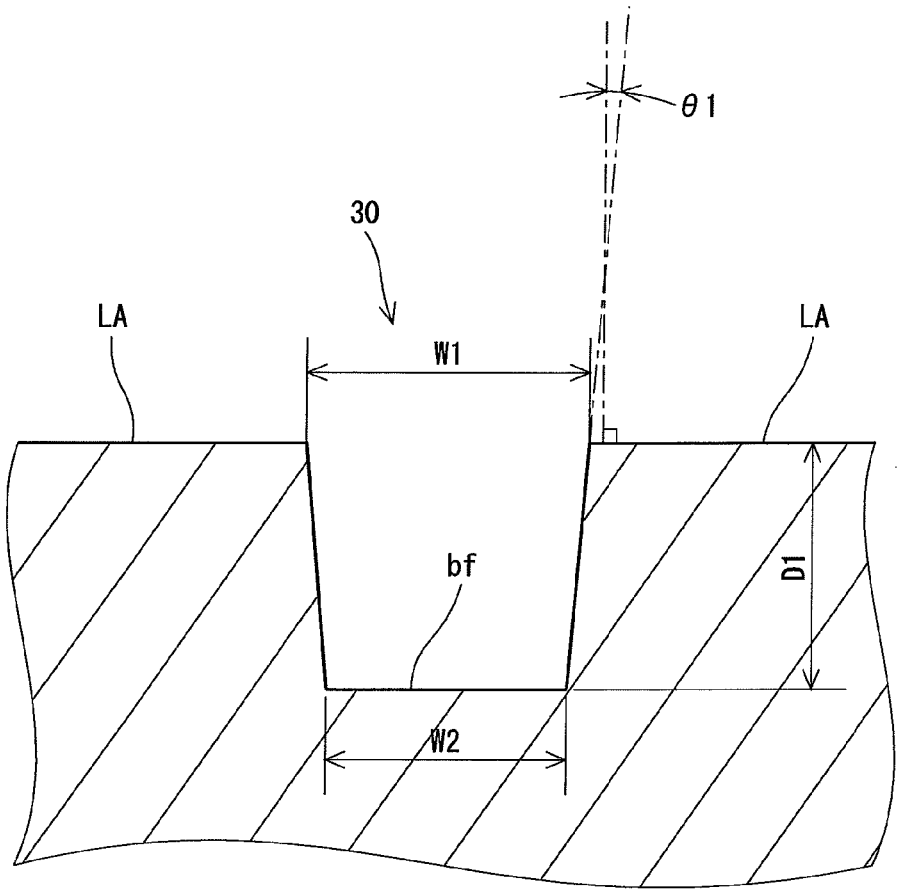
FIG. 8 is a cross sectional view of a vicinity of a face line of a head according to comparative example 1.

FIG. 8 is a cross sectional view of the face line of the head of the comparative example 1. A roundness was not applied to the side face of the face line, including the edge of the face line. A groove angle θ1 (see FIG. 8) was set to 5 degrees. A groove width W1 is a distance between both edges (see FIG. 8).

Figure 9:
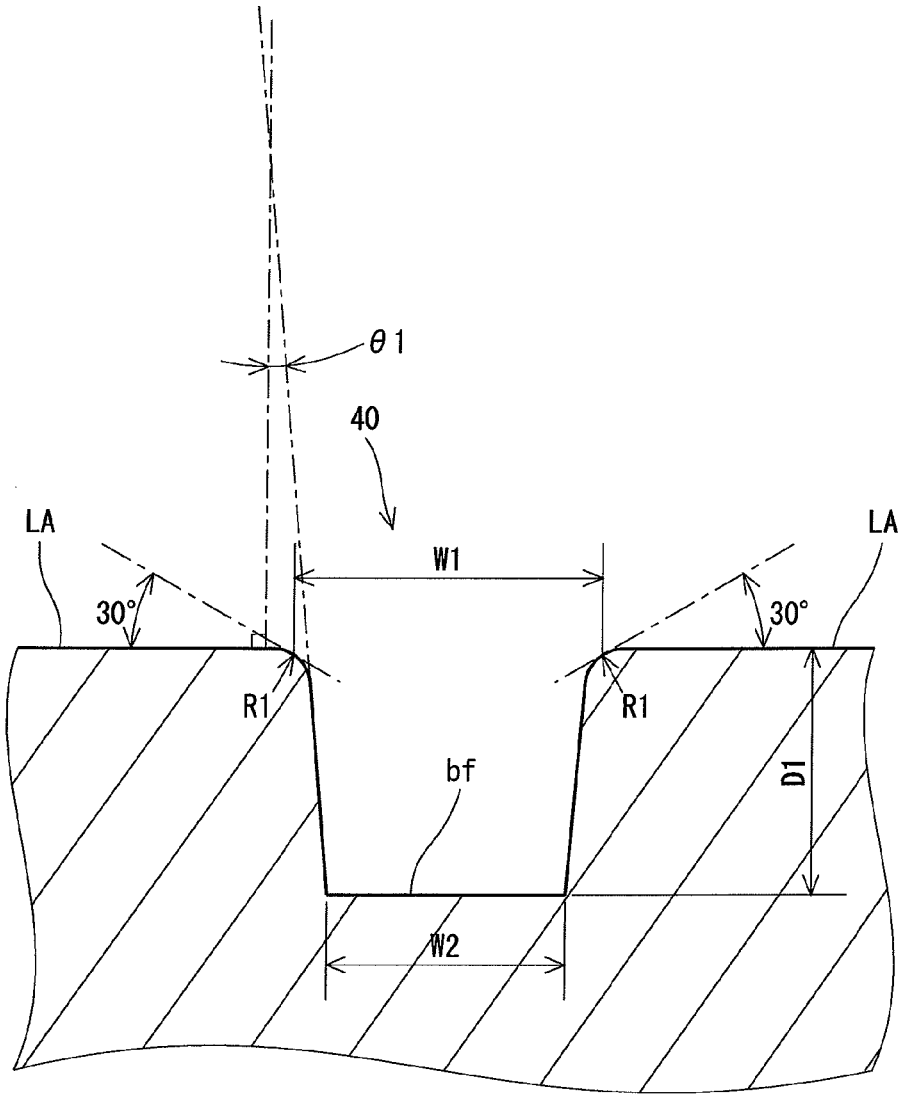
FIG. 9 is a cross sectional view of a vicinity of a face line of a head according to comparative examples 2 and 3.

FIG. 9 is a cross sectional view of the face line of the heads of the comparative examples 2 and 3. A roundness having a curvature radius R1 was applied to the edge of the face line. The side face of the face line was formed as a plane except for a portion to which the curvature radius R1 was applied. A groove width W1 was measured by 30 degree method of measurement. In the comparative example 2, a groove angle θ1 (see FIG. 9) was set to 5 degrees. Also, in the comparative example 3, a groove angle θ1 was set to 5 degrees.

The specifications and evaluation results of the examples and the comparative examples are shown in the following Table 1. In a column described as the angle θ1 (θa) in Table 1, the angle θ1 is described for the comparative examples 1 to 3 and the angle θa is described for the examples 1 to 6.

A valuation method is as follows. A golf ball used for evaluating a backspin rate was "SRIXON Z-STAR" (trade name) which was manufactured by SRI Sports Limited.

[Backspin Rate]

The club was mounted to a swing robot, and a head speed was set to 21 m/s to carry out test. The average value of fifty measurements is shown in the following Table 1. Values obtained by rounding off to nearest hundred are described in Table 1.

[Evaluation of Foreign Matter Discharge Property]

The club was mounted to the swing robot, and the head speed was set to 21 m/s to carry out test. A container filled with muddy earth was prepared. The club was duffed in the layer part of the muddy earth under a fixed condition, and swing was carried out on a condition close to actual shot. In the swing, the muddy earth adhered to the face surface. The muddy earth adhering to the land area LA was removed, and only the muddy earth adhering in the face line was left. A weight wt1 of the head was measured by a precision mass meter. Next, the inside of the face line was washed to remove the muddy earth adhering in the face line. Then, a weight wt2 of the head was measured by the precision mass meter. A mass g1 of the muddy earth adhering in the face line was calculated by the difference (wt1−wt2). An index when a mass g1 of the comparative example 1 is set to 100 is shown in the following Table 1. As the index is smaller, the face line has excellent foreign matter discharge property.

[Durability of Cutter]

The cutter was continuously used until crack arose in the cutter. The number of the heads capable of being processed by one cutter was confirmed. Whenever five heads were processed, the cutter was inspected to confirm whether the crack arose. The number of the processed heads at the time of finding the crack of the cutter is shown in the following Table 1.

TABLE 1

Specifications and evaluation results of examples and comparative examples

| | Unit | Comparative Example 1 | Comparative Example 2 | Comparative Example 3 | Example 1 | Example 2 | Example 3 | Example 4 | Example 5 | Example 6 |
|---|---|---|---|---|---|---|---|---|---|---|
| R1 | mm | none | 0.10 | 0.10 | 0.40 | 0.40 | 0.40 | 0.70 | 0.40 | 0.40 |
| r1 | mm | none | none | none | 0.04 | 0.04 | 0.04 | 0.04 | 0.04 | none |
| T1 | mm | 0.00 | 0.08 | 0.08 | 0.30 | 0.25 | 0.30 | 0.30 | 0.30 | 0.30 |
| H1 | mm | 0.00 | 0.00 | 0.00 | 0.03 | 0.03 | 0.03 | 0.03 | 0.03 | 0.00 |
| D1 | mm | 0.30 | 0.30 | 0.40 | 0.33 | 0.28 | 0.33 | 0.33 | 0.33 | 0.30 |
| W1 | mm | 0.70 | 0.70 | 0.70 | 0.70 | 0.70 | 0.80 | 0.70 | 0.90 | 0.70 |
| W2 | mm | 0.68 | 0.68 | 0.65 | 0.40 | 0.42 | 0.50 | 0.40 | 0.40 | 0.40 |
| R1/T1 | — | — | 1.25 | 1.25 | 1.33 | 1.60 | 1.33 | 2.33 | 1.33 | 1.33 |

TABLE 1-continued

Specifications and evaluation results of examples and comparative examples

| | Unit | Comparative Example 1 | Comparative Example 2 | Comparative Example 3 | Example 1 | Example 2 | Example 3 | Example 4 | Example 5 | Example 6 |
|---|---|---|---|---|---|---|---|---|---|---|
| W1/W2 | — | 1.03 | 1.03 | 1.08 | 1.75 | 1.67 | 1.60 | 1.75 | 2.25 | 1.75 |
| θ1(θa) | degree | 5 | 5 | 5 | 0 | 0 | 0 | 0 | 0 | 0 |
| Backspin Rate | rpm | 7000 | 6000 | 6200 | 6500 | 6300 | 6700 | 6400 | 6500 | 6400 |
| Foreign matter discharge property | Index | 100 | 96 | 109 | 71 | 59 | 62 | 51 | 58 | 79 |
| Durability of cutter | — | 30 | 25 | 20 | 40 | 40 | 45 | 40 | 50 | 35 |

As shown in Table 1, the examples are highly evaluated as compared with the comparative examples. From the results, the advantages of the present invention are apparent.

The present invention can be applied to all the golf club heads provided with the face lines. The present invention can be used for an iron type golf club head, a wood type golf club head, a utility type golf club head, a hybrid type golf club head, and a putter type golf club head or the like.

The description hereinabove is merely for an illustrative example, and various modifications can be made in the scope not to depart from the principles of the present invention.

What is claimed is:

1. A golf club head comprising:

a face line having a depth of D1 (mm); and a land area, wherein if a boundary point between the land area and the face line in a section line of a surface of the face line is defined as Pa; a point of which a depth is T1 (mm) in the section line is defined as Pb; and a curvature radius of the section line between the point Pa and the point Pb is defined as R1 (mm), the golf club head satisfies the following formulae (1) and (2):

$$R1>T1 \quad (1)$$

$$0.10\leq T1\leq 0.5 \quad (2)$$

and wherein if a bottom face width of the face line is defined as W2 (mm), the width W2 is 0.2 (mm) or greater and 0.7 (mm) or less.

2. The golf club head according to claim 1, wherein a ratio (R1/T1) is greater than 1.0 and is equal to or less than 3.0.

3. The golf club head according to claim 1, wherein if a face line width measured by 30 degree method of measurement is defined as W1 (mm) and a bottom face width of the face line is defined as W2 (mm), a ratio (Wl/W2) is 1.5 or greater and 3.0 or less.

4. The golf club head according to claim 1, wherein if a point at a height H1 (mm) from a bottom face of the face line that is in a section line of a surface of the face line is defined as Pc, and an intersection point of a side face of the face line and the bottom face of the face line is defined as Pd, the point Pc coincides with the point Pb, or is located on a bottom face side with respect to point Pb;

a roundness having a curvature radius of r1 (mm) and projecting toward the outside of the face line is present between the point Pc and the point Pd; and the curvature radius r1 is smaller than the curvature radius R1.

5. The golf club head according to claim 1, if a point at a height H1 (mm) from a bottom face of the face line that is in a section line of a surface of the face line is defined as Pc, and an intersection point of a side face of the face line and the bottom face of the face line is defined as Pd, the point Pc coincides with the point Pb, or is located on a bottom face side with respect to point Pb;

a roundness having a curvature radius of r1 (mm) and projecting toward the outside of the face line is present between the point Pc and the point Pd; and wherein the curvature radius R1 is constant and the curvature radius r1 is constant.

6. The golf club head according to claim 1, if a point at a height H1 (mm) from a bottom face of the face line that is in a section line of a surface of the face line is defined as Pc, and an intersection point of a side face of the face line and the bottom face of the face line is defined as Pd, the point Pc coincides with the point Pb, or is located on a bottom face side with respect to point Pb;

a roundness having a curvature radius of r1 (mm) and projecting toward the outside of the face line is present between the point Pc and the point Pd; and wherein a side face of the face line is occupied by only a first portion having the curvature radius R1 and a second portion having the curvature radius r1.

7. The golf club head according to claim 1, wherein the face line is formed by a cutting process using a cutter.

8. The golf club head according to claim 1, wherein the curvature radius R1 is equal to or less than 0.80 (mm).

9. The golf club head according to claim 1, wherein if a face line width measured by a 30 degree method of measurement is defined as W1 (mm), the width W1 is 0.4 (mm) or greater and 0.9 (mm) or less.

10. The golf club head according to claim 1, wherein if a point at a height H1 (mm) from a bottom face of the face line that is in a section line of a surface of the face line is defined as Pc, and an intersection point of a side face of the face line and the bottom face of the face line is defined as Pd, the point Pc coincides with the point Pb, or is located on a bottom face side with respect to the point Pb;

a roundness having a curvature radius of r1 (mm) and projecting toward the outside of the face line is present between the point Pc and the point Pd; and the curvature radius r1 is 0.02 (mm) or greater and 0.15 (mm) or less.

11. A golf club head comprising:

a face line having a depth of D1 (mm); and a land area, wherein if a boundary point between the land area and the face line in a section line of a surface of the face line is defined as Pa; a point of which a depth is T1 (mm) in the section line is defined as Pb; and a curvature radius of the section line between the point Pa and the point Pb is defined as R1 (mm), the golf club head satisfies the following formulae (1) and (2):

$$R1>T1 \quad (1)$$

$$0.10 \leq T1 \leq 0.5 \quad (2)$$

wherein if a face line width measured by 30 degree method of measurement is defined as W1 (mm) and a bottom face width of the face line is defined as W2 (mm), a ratio (W1/W2) is 1.5 or greater and 3.0 or less.

12. The golf club head according to claim 11, wherein a ratio (R1/T1) is greater than 1.0 and is equal to or less than 3.0.

13. The golf club head according to claim 11, wherein if a point at a height H1 (mm) from a bottom face of the face line that is in a section line of a surface of the face line is defined as Pc, and an intersection point of a side face of the face line and the bottom face of the face line is defined as Pd, the point Pc coincides with the point Pb, or is located on a bottom face side with respect to point Pb;

a roundness having a curvature radius of r1 (mm) and projecting toward the outside of the face line is present between the point Pc and the point Pd; and the curvature radius r1 is smaller than the curvature radius R1 .

14. The golf club head according to claim 11, if a point at a height H1 (mm) from a bottom face of the face line that is in a section line of a surface of the face line is defined as Pc, and an intersection point of a side face of the face line and the bottom face of the face line is defined as Pd., the point Pc coincides with the point Pb, or is located on a bottom face side with respect to point Pb;

a roundness having a curvature radius of r1 (mm) and projecting toward the outside of the face line is present between the point Pc and the point Pd; and wherein a side face of the face line is occupied by only a first portion having the curvature radius R1 and a second portion having the curvature radius r1.

15. The golf club head according to claim 11, wherein the face line is formed by a cutting process using a cutter.

16. The golf club head according to claim 11, wherein if a face line width measured by a 30 degree method of measurement is defined as W1 (mm), the width W1 is 0.4 (mm) or greater and 0.9 (mm) or less.

17. A golf club head comprising:

a face line having a depth of D1 (mm); and a land area, wherein if a boundary point between the land area and the face line in a section line of a surface of the face line is defined as Pa; a point of which a depth is T1 (mm) in the section line is defined as Pb; and a curvature radius of the section line between the point Pa and the point Pb is defined as R1 (mm), the golf club head satisfies the following formulae (1) and (2):

$$R1>T1 \quad (1)$$

$$0.10 \leq T1 \leq 0.5 \quad (2)$$

wherein if a point at a height H1 (mm) from a bottom face of the face line that is in a section line of a surface of the face line is defined as Pc, and an intersection point of a side face of the face line and the bottom face of the face line is defined as Pd, the point Pc coincides with the point Pb, or is located on a bottom face side with respect to the point Pb;

a roundness having a curvature radius of r1 (mm) and projecting toward the outside of the face line is present between the point Pc and the point Pd; and the curvature radius r1 is 0.02 (mm) or greater and 0.15 (mm) or less.

18. The golf club head according to claim 17, wherein the curvature radius rl is smaller than the curvature radius R1.

19. The golf club head according to claim 17, wherein a side face of the face line is occupied by only a first portion having the curvature radius R1 and a second portion having the curvature radius r1.

20. The golf club head according to claim 17, wherein the curvature radius R1 is equal to or less than 0.80 (mm).

* * * * *